United States Patent [19]

Governale

[11] 4,114,319

[45] Sep. 19, 1978

[54] BOTTOM SWEEP AND RAIL UNIT FOR FOAM-FILLED DOORS

[75] Inventor: Bernard C. Governale, Duluth, Ga.

[73] Assignee: Peachtree Doors, Inc., Norcross, Ga.

[21] Appl. No.: 863,908

[22] Filed: Dec. 23, 1977

[51] Int. Cl.[2] ..... E06B 7/16

[52] U.S. Cl. ..... 49/488; 49/470; 49/501

[58] Field of Search ..... 49/488, 470, 501, 468; 52/620

[56] References Cited

U.S. PATENT DOCUMENTS

| | | | |
|---|---|---|---|
| 2,560,308 | 7/1951 | Sparagen | 49/488 |
| 2,949,651 | 8/1960 | Hill | 49/488 X |
| 3,967,412 | 7/1976 | Governale | 49/468 |
| 3,987,588 | 10/1976 | Imperial et al. | 49/501 |

*Primary Examiner*—Philip C. Kannan

[57] ABSTRACT

To replace the customary wood bottom rail of a foam-filled metal skinned door, a prefabricated metallic bottom rail and Neoprene bottom sweep unit is utilized. The unit forms a closure for the bottom of the door panel during foaming and provides a better bond with the foam core and better anchorage therein.

5 Claims, 4 Drawing Figures

FIG.1
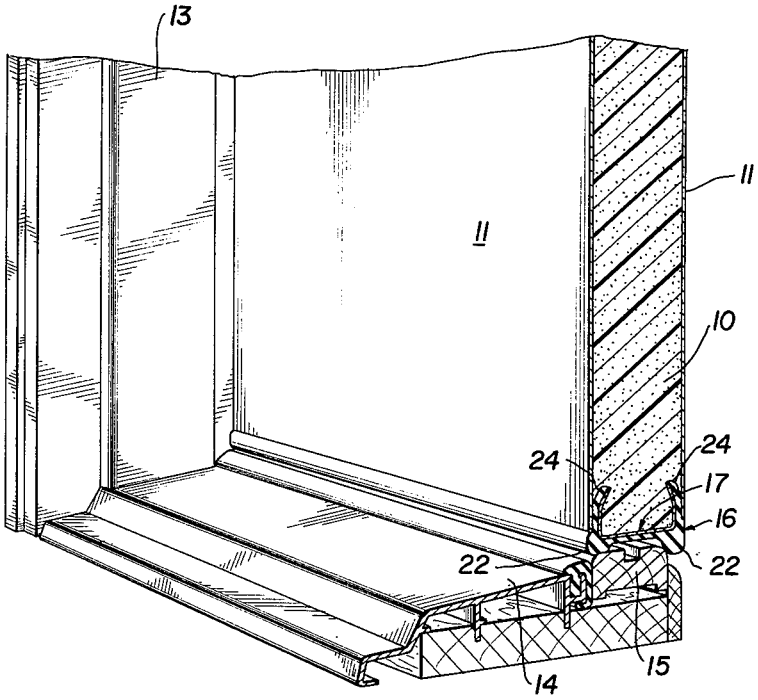
FIG.2
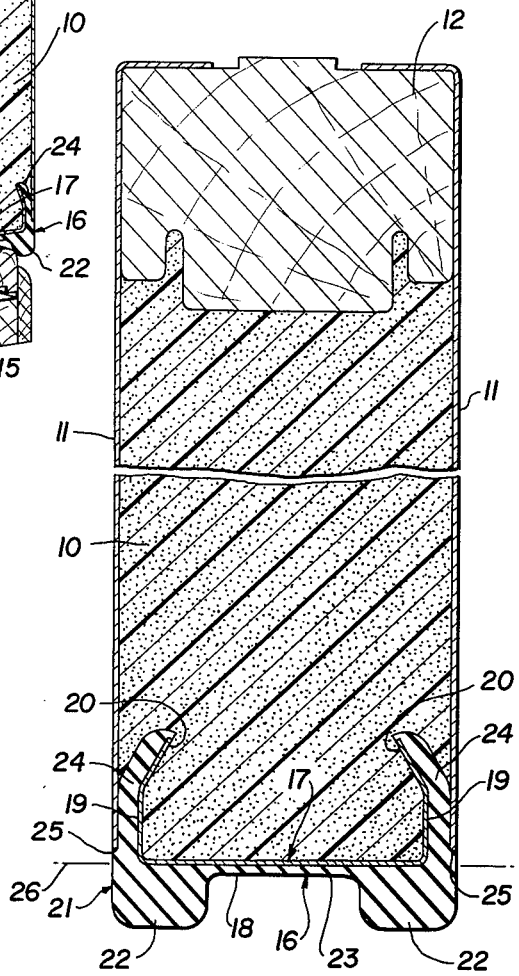
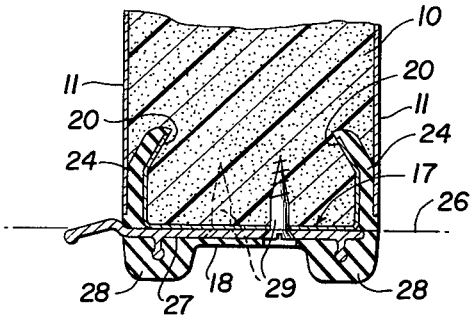
FIG.3
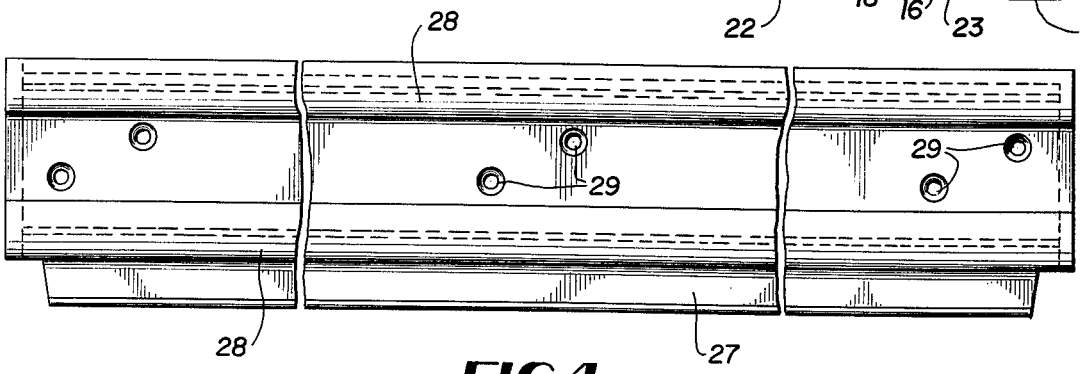
FIG.4

BOTTOM SWEEP AND RAIL UNIT FOR FOAM-FILLED DOORS

BACKGROUND OF THE INVENTION

Customarily, in the prior art, foam core doors embody two wooden stiles, top and bottom wooden rails, and two metal skins. These elements are bonded together as an integral unit by a core of foam insulation. Some form of bottom sweep is then attached to the door by stapling, nailing or screwing into the wood bottom rail. The sweep acts as a weather seal when in contact with the frame threshold.

The present invention is an improvement on the prior art and the essence of the invention resides in the provision of a prefabricated sheet steel bottom rail with integrally molded Neoprene bottom sweep thereon, the prefabricated unit forming a bottom closure for the foam-filled door panel of increased structural integrity and efficiency.

Among the numerous advantages of the invention over the prior art are the elimination of the danger of rot at the bottom edge of the door as frequently happens where unpainted wood bottom rails are exposed to the weather; the provision of a better thermal break at the bottom of the door; elimination of ineffective fastening of the bottom sweep to the bottom rail; better positioning and squareness of the bottom rail structure; better anchorage and bonding with the urethane foam core to thereby increase the structural strength of the entire door without dependency on mastics or adhesives; a more efficient bottom sweep material by utilizing Neoprene which is less effected by temperature extremes; protection for the ungalvanized bottom edges of the metal skins which have been subject to rusting in the prior art; and easy replacement of the Neoprene bottom sweep by means of a simple unitized replacement assembly after trimming off the worn sweep flush with the bottom face of the metal bottom rail.

Some examples of the patented prior art are contained in the following U.S. patents:

U.S. Pat. No. 1,877,729
U.S. Pat. No. 1,949,193
U.S. Pat. No. 2,592,861
U.S. Pat. No. 2,686,943
U.S. Pat. No. 2,949,651
U.S. Pat. No. 3,024,504
U.S. Pat. No. 3,068,136
U.S. Pat. No. 3,334,464
U.S. Pat. No. 3,518,792
U.S. Pat. No. 3,762,100
U.S. Pat. No. 3,796,008
U.S. Pat. No. 3,834,101

BRIEF DESCRIPTION OF THE DRAWINGS

FIG. 1 is a perspective view, partly in section, of a bottom rail and sweep unit for foam-filled doors embodying the invention.

FIG. 2 is an enlarged fragmentary vertical cross section through a door equipped with the invention.

FIG. 3 is a similar cross sectional view, on a reduced scale, showing a bottom sweep replacement unit.

FIG. 4 is a fragmentary bottom plan view of the replacement unit.

DETAILED DESCRIPTION

Referring to the drawings in detail, wherein like numerals designate like parts, an entry door is illustrated having an insulating foam core 10 of urethane or equivalent material, opposite side metal skins 11, a wooden top rail 12 and wooden stiles, not shown. In FIG. 1, the entry door is shown installed in a frame 13 having an extruded metal threshold 14 including an adjustable threshold member 15. While the invention is ideally suited for use with this type of threshold, it may if desired be utilized with other types of thresholds including those which are non-adjustable.

The invention proper is a unitized bottom rail and bottom sweep assembly 16 including a roll formed sheet steel bottom rail 17 of channel formation including a flat bottom wall 18 of somewhat lesser width than the thickness of the door panel between the parallel skins 11. The rail 17 further includes upstanding parallel vertical side webs 19 at right angles to the bottom wall 18, and top upwardly converging inclined terminal flanges 20, as illustrated.

During its fabrication, the steel bottom rail 17 has a Neoprene bottom sweep 21 integrally molded thereon and permanently bonded thereto. This bottom sweep comprises two thick roughly rectangular cross section sweep ribs 22 at the inner and outer sides of the door panel, joined and intervened by a thin wall 23 covering the remainder of the bottom wall 18. The sweep 21 additionally comprises rising side walls 24 which completely cover the outer faces of the webs 19 and flanges 20 and are bonded thereto. The sweep 21 has opposite side ledges or shoulders 25 which cover and protect the raw bottom edges of the metal skins 11 and prevent rusting of these elements which are usually ungalvanized.

The assembly or unit 16 is fabricated separately from the remainder of the door and installed in the open bottom edge of the door panel instead of the customary wood bottom rail with bottom sweep attached thereto by nailing, stapling or the like. The unit 16 forms a closure for the bottom of the door panel to facilitate the foaming operation and a superior bond is achieved between the urethane foam and the exposed interior faces of the channel-like metal rail 17. Also, the angled flanges 20 provide better anchorage of the unit 16 in the foam core. The unit 16 also imparts increased structural strength to the door and in general provides for a more efficient operation and longer life of the sweep 21 compared to conventional sweeps which are attached by nails or staples with resulting unevenness and a tendency to separate from the door. The most important advantages of the invention have been enumerated previously and should be readily apparent to the artisan.

With reference to FIGS. 3 and 4, the invention also provides a convenient means for replacing the portions of the bottom sweep 21 which are subject to gradual wear. More particularly, when the ribs 22 are worn beyond the point of effectiveness, the Neoprene sweep can be trimmed off with a razor blade cutter at the trim line 26 flush with the bottom face of the wall 18. Following this, FIG. 3, a prefabricated replacement unit consisting of an extruded metal plate 27 and replacement sweep ribs 28 of Neoprene is attached by screws 29 directly to the metal bottom wall 18 which remains in place on the door panel along with anchoring flanges 20 and Neoprene side walls 24 embedded in the foam core 10. The replacement unit is simple and convenient and restores the full usefulness of the bottom sweep without disturbing the structural integrity afforded by the metal bottom rail 17.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A unitized prefabricated bottom rail and bottom sweep assembly for foam-filled doors having metal skins thereon, said assembly comprising a channel cross section sheet metal bottom rail of lesser width than the thickness of a door between the metal skins which receive said assembly, and a bottom sweep of elastic material molded on the exterior surfaces only of the channel cross section sheet metal bottom rail in permanently bonded relation thereto, said unitized assembly adapted for snug insertion in the bottom of a foam-filled door between the metal skins thereof in lieu of the customary wood bottom rail and separately attached sweep, the entire interior surface of the sheet metal bottom rail being exposed for direct contact with foam material in said door between the metal skins of the door.

2. A unitized prefabricated bottom rail and bottom sweep assembly for foam-filled doors having metal skins thereon, said assembly comprising a channel cross section sheet metal bottom rail of lesser width than the thickness of the door which receives said assembly, and a bottom sweep of elastic material molded on the exterior surfaces only of the sheet metal bottom rail and permanently bonded thereto, said unitized assembly adapted for insertion in the bottom of a foam-filled door between the metal skins thereof in lieu of the customary wood bottom rail and separately attached sweep, and said channel cross section sheet metal bottom rail having a pair of top inclined upwardly converging flanges forming embedded anchors in a foam core of a foam-filled door, said bottom sweep having side wall portions covering the exterior faces of said embedded anchors.

3. A unitized prefabricated bottom rail and bottom sweep assembly as defined in claim 1, and said bottom sweep further having opposite side continuous parallel thick depending sweep ribs extending substantially below said sheet metal bottom rail.

4. In a foam-filled door having opposite side metal skins, a unitized bottom rail and bottom sweep assembly forming a closure for the bottom edge of the door, said assembly comprising a continuous channel cross section metallic bottom rail of lesser width than the thickness of the door between said metal skins, and a bottom sweep of elastic material molded directly onto the exterior surfaces of said metallic bottom rail in permanently bonded relation thereto and having bottom comparatively thick sweep ribs and side walls rising from said ribs, said unitized assembly including the sweep side walls and adjacent side wall portions of said channel cross section metallic bottom rail being inserted snugly between said metal skins and being embedded permanently in the foam core of said foam-filled door.

5. In a foam-filled door having opposite side metal skins as defined in claim 4, and said channel cross section metallic bottom rail including upper angled converging flanges forming anchor elements within said foam core.

* * * * *